US006286396B1

(12) United States Patent
Johnson

(10) Patent No.: US 6,286,396 B1
(45) Date of Patent: Sep. 11, 2001

(54) SOCKET RATCHET AND EXTENSION HANDLE

(76) Inventor: Mark P. Johnson, 10070 East Dr., Grass Valley, CA (US) 95945

( * ) Notice: Subject to any disclaimer, the term of this patent is extended or adjusted under 35 U.S.C. 154(b) by 0 days.

(21) Appl. No.: 09/583,752

(22) Filed: May 31, 2000

Related U.S. Application Data

(63) Continuation-in-part of application No. 09/087,962, filed on Jun. 1, 1998, now abandoned.

(51) Int. Cl.[7] ..... B25B 13/46; B25B 23/16

(52) U.S. Cl. ..... 81/60; 81/177.2; 81/177.7; 81/177.5

(58) Field of Search ..... 81/60–63.2, 177.2, 81/177.7, 177.8, 177.9, 177.5, 900, 177.1, 489, 24

(56) References Cited

U.S. PATENT DOCUMENTS

| | | | | |
|---|---|---|---|---|
| 662,966 | | 12/1900 | Robertson . | |
| 980,632 | | 1/1911 | Hartvigsen . | |
| 1,075,100 | | 10/1913 | Habel . | |
| 1,568,442 | | 1/1926 | Carver . | |
| 1,643,814 | | 9/1927 | Peterson . | |
| 2,068,207 | | 1/1937 | Torbert, Jr. . | |
| 2,627,330 | | 2/1953 | Gantz . | |
| 3,270,597 | | 9/1966 | Neff et al. . | |
| 3,882,753 | | 5/1975 | Svensen . | |
| 4,406,186 | | 9/1983 | Gummow . | |
| 4,520,997 | * | 6/1985 | Lorton, Sr. | 81/24 |
| 4,753,138 | * | 6/1988 | Soucy | 81/24 |
| 5,280,740 | | 1/1994 | Ernst . | |
| 5,471,899 | | 12/1995 | Twomlow . | |
| 5,517,884 | | 5/1996 | Sanders . | |
| 5,794,497 | * | 8/1998 | Anderson | 81/451 |
| 5,860,337 | | 1/1999 | Janssen . | |
| 5,896,606 | | 4/1999 | Huang . | |
| 6,032,557 | * | 3/2000 | Anderson | 81/451 |

FOREIGN PATENT DOCUMENTS

| | | |
|---|---|---|
| 806780 | 6/1951 | (DE) . |
| 2823464 | 12/1979 | (DE) . |
| 15942 | 4/1912 | (DK) . |
| 0123456 | 1/2000 | (EP) . |
| 1027581 | 5/1953 | (FR) . |

* cited by examiner

*Primary Examiner*—D. S. Meislin
(74) *Attorney, Agent, or Firm*—Richard C. Litman

(57) ABSTRACT

A ratchet wrench consisting of a socket driver head pivoting or fixed at one end, an elongated handle in the middle, and a pivoting extension shaft having an extended handle grip at the opposite end. The wrench is designed to install and tighten nuts onto machine bolts and break loose and remove nuts from machine bolts wherein the nut is in a recessed or confined area making it hard to reach with a conventional fixed-handle ratchet wrench. The extended handle grip is generally U-shaped with a linear section perpendicular to and substantially centered about the end of the extension shaft. The U-shaped handle of the extension shaft extends the user's reach when applying the torque necessary to install or remove a nut located in a cramped work space. In addition, the U-shaped handle includes a magnet for retrieving articles that are out of the reach of the user.

6 Claims, 9 Drawing Sheets

SOCKET RATCHET AND EXTENSION HANDLE

CROSS REFERENCE TO RELATED APPLICATIONS

This application is a continuation-in-part of application Ser. No. 09/087,962 filed Jun. 1, 1998, now abandoned.

BACKGROUND OF THE INVENTION

1. Field of the Invention

The present invention relates to a ratchet wrench. More specifically, the invention relates to a ratchet wrench having a handle with a magnetic extension handle pivotally attached to the wrench handle.

2. Description of the Related Art

Mechanics often find it necessary to install a nut onto or remove a nut from a threaded machine bolt where the nut is located in a confined area which precludes the use of a conventional ratchet wrench. Conventional ratchet wrenches are not suitable for use in such confined areas because of interference with the back and forth action of the ratchet handle or because the mechanic cannot reach the area in such a way as to transmit the necessary torque to the wrench handle to facilitate the installation or removal process. Accordingly, there is a need for a simple and relatively inexpensive ratchet-based tool for extending the user's reach when applying the necessary torque to work on nuts threaded onto machine bolts in confined or recessed areas. This invention provides such a ratchet-based tool.

One improvement, seen in wrenches used for working in confined areas, is to have the driver pivot with respect to the wrench stock. For example, U.S. Pat. No. 662,966 issued to Robertson on Dec. 4, 1900, U.S. Pat. No. 980,632 issued to Hartvigsen on Jan. 3, 1911 and U.S. Pat. No. 1,643,814 issued to Peterson on May 11, 1926 describe wrench stock assemblies which may be positioned in alignment with the longitudinal axis of a nut engaging socket or arranged at an angle to the socket to enable the socket to operate on nuts which are not readily accessible with an ordinary wrench. A cross bar handle is provided to increase available socket torque. However, in either configuration, socket torque in a confined space is limited by the user's ability to rotate the wrench stock about its longitudinal axis. Unlike the Robertson, Hartvigsen or Peterson wrenches, the present invention offers an increased ability to transmit torque to the wrench head in a confined space by taking full advantage of the mechanical lever action offered by a ratchet wrench handle manipulated back and forth by a pivoting T-gripped extension shaft.

Other wrench configurations are known which provide for the exertion of the necessary tightening or losing torque on a nut in a confined space. In U.S. Pat. No. 2,627,330 issued to Gantz on Jul. 3, 1948, the wrench handle is attached to an extension shank. Access to a nut in a confined space is governed by the length of the extension shank. However, because the handle must be rotated about the longitudinal axis of the extended shank to work on the nut, this structure, like many others, presupposes free access for a considerable distance outwardly from the nut in line with the longitudinal axis of the extended shank.

Additionally, U.S. Pat. No. 3,270,597 issued to Neff et al. on Sep. 6, 1966 discloses a locking adjustable angle wrench extension handle. This structure provides an increased ability to work in confined spaces compared to a standard fixed handle wrench. However, the swing of the adjustable angle wrench extension handle during the back and forth ratchet movement may still be restricted unless there is significantly free access along the arc described by the handle's swing.

An additional type of wrench described in the patent literature is the dual action or "speed" wrench. This wrench structure can be used in a first configuration to cause force on the wrench handle to be applied directly to the shank to tighten or loosen nuts. It can also be used in a second configuration wherein the handle can be moved to cause the shank to rotate rapidly to spin the nut on or off a bolt under conditions of lesser load.

For instance, U.S. Pat. No. 5,517,884 issued to Sanders on May 21, 1996 describes a ratchet wrench handle threadedly connected to a handle extension. The wrench handle opposite the head is centrally bored for slidably receiving a rod member hingedly connected with the handle extension permitting the handle extension to be disposed normal to the longitudinal axis of the wrench handle. In this position, the wrench handle can be moved in a rapid fashion under a lesser load condition through a selected arc. However, with the handle extension disposed normal to the longitudinal axis of the wrench handle, this structure presupposes free access for a considerable distance outwardly from the nut in line with the longitudinal axis of the nut.

Similarly, U.S. Pat. No. 5,280,740 issued to Ernst on Jan. 25, 1994 shows a socket wrench with a pivoting socket driver head and a handle that is rotatable about the longitudinal axis of the wrench shaft. In a first position, with the wrench shaft parallel to the socket driver head, the wrench can be used in the same manner as a fixed handle wrench to apply significant torque to the driver head. Additionally, the wrench shaft may be pivoted with respect to the socket driver head to a second position whereby the wrench shaft is parallel to the driver. In this second position, the handle may be used in a cranking manner to spin a nut about a bolt under lesser load conditions. As seen with the Sanders wrench, in the second position, the Ernst structure also presupposes free access for a considerable distance outwardly from the nut in line with the longitudinal axis of the nut.

U.S. Pat. No. 4,406,186 issued to Gummow on Sep. 27, 1983 shows a ratchet wrench with a handle pivot pin mounted on the wrench body at a side opposite the shank and having its axis parallel to and spaced from the axis of the shank. An elongated wrench handle is mounted on the pivot pin and is movable with respect to the wrench body between a first position wherein the handle fits into the wrench body and is thus locked with respect to angular movement between the wrench body and the handle and a second position where it is above and spaced from the wrench body and can rotate freely about the pivot pin to cause the wrench body to rotate freely about the axis of the shank.

In the first position, the Gummow wrench does not provide any advantage over a standard fixed handle wrench when working on a nut in a confined space. In the second position, the Gummow wrench may be used to reach a nut in a confined space. However, the second position is only appropriate where the nut can be rapidly rotated under lesser load conditions.

In order to exert any significant torque in an attempt to fully tighten or loosen a nut, the user is required to apply a force along the longitudinal axis of the wrench handle while grasping the wrench handle in a bent-wrist fashion. Furthermore, it is apparent that the short moment arm of the Gummow wrench, in the second position, precludes the application of significant torque on a nut. On the other hand, the T-gripped handle of the present invention allows the user to apply significant torque to the driver by exerting force along the longitudinal axis of the extension shaft with the hand and fingers substantially parallel to the forearm in a fixed-wrist position.

Other types of tools have evolved for reducing the physical exertion on the user. For example U.S. Pat. No. 1,075,100, issued Oct. 7, 1913 to Habel, discloses a wrench having a T-shaped handle end to facilitates better grasping of the wrench during use. The handle has a permanent pivot upon which the wrench head hinges. In addition, there is no way of using the tool for article retrieval.

U.S. Pat. No. 1,568,442, issued Jan. 5, 1926 to Carver, and U.S. Pat. No. 2,068,207, issued to Torbert, Jr., disclose a wrench having an angularly positionable wrench head with respect to the handle. U.S. Pat. No. 3,882,753, issued May 13, 1975 to Svensen, discloses a wrench having an angled free turning grip for rapid tightening of threaded fasteners.

Denmark Patent Document No. 15,942, published Apr. 25, 1912, shows a hand tool having a head that pivots with respect to the handle shaft. French Patent Document No. 1,027,581, published May 13, 1953, shows a rapid-turning wrenching hand tool having a positionable handle member. German Patent Document No. 806,780, published Jun. 18, 1951, shows a rail anchor and alignment tool having a L/T-shaped extended handle for increasing turning torque. German Patent Document No. 2,823,464, published Dec. 6, 1979, shows a telescopic lever for use with a cruciform wrench for removing automobile wheel retaining nuts. These patents, likewise, have no means for article retrieval.

U.S. Pat. No. 5,474,899, issued Dec. 5, 1995 to Twomlow, discloses ratchet wrench tool having an extensible handle for increasing the length and moment arm for greater reach and torque. U.S. Pat. No. 5,860,337, issued Jan. 19, 1999 to Janssen, discloses a hand tool having an elongated handle, a pivoting end connector and a variety of interchangeable ratcheting heads. The pivoting end connector is restricted to turn within an arc of less than 180°. These patents do not provide a magnet at the end of the handle for extending the users reach in retrieving dropped metal articles.

U.S. Pat. No. 5,896,606, issued Apr. 27, 1999 to Huang, discloses a hand tool having a multiplicity of features, including a magnet on a telescopic secondary shaft that extends rearwardly from within the primary tool shaft. In use the user must extend the telescopic shaft, which generally lacks integrity when fully extended. This tool also does not include a pivoting ratcheting driver head for engaging a workpiece in a confined environment.

None of the above inventions and patents, taken either singularly or in combination, is seen to describe the instant invention as claimed. Thus, a socket ratchet with a T-gripped handle extension solving the aforementioned problems is desired.

SUMMARY OF THE INVENTION

The present invention is directed to a tool designed for working in a confined area to install and tighten nuts onto machine bolts and break loose and remove nuts from machine bolts. The tool includes a socket driver head (either pivoting or fixed) at one end, a wrench handle in the middle, and a pivoting T-gripped extension shaft at the opposite end. The pivoting T-gripped extension shaft has advantages over other wrench means for reaching confined work areas in that the user exerts force along the longitudinal axis of the extension shaft by grasping the extension shaft's T-gripped handle with the hand and fingers substantially parallel to the forearm in a fixed-wrist position. The force exerted by the user is therefore transmitted to the socket driver head through the combined lever arms of the wrench handle and socket driver head. Moreover, in the pivoting socket driver head embodiment, pivoting the elongated handle to a second position allows the tool to function in a work space where obstructions would limit the movement of the elongated handle if it remained in a first position.

More specifically, in the pivoting socket head embodiment, the tool comprises an elongated handle with a first end and a second end. A longitudinal axis is defined along the elongated handle between the first end and second end. A first hinge is provided at the first end. The first hinge has a single axis of rotation. A second hinge is provided at the second end. The second hinge has a single axis of rotation.

The axis of the second hinge is rotationally displaced 90 degrees from the axis of the first hinge with respect to rotation about the longitudinal axis of the elongated handle such that the axis of the second hinge is perpendicular to the axis of the first hinge. A tool engaging head including a driver is hinged to the first end of the elongated handle by means of the first hinge.

Additionally, an extension shaft with a first end and a second end is provided. The first end of the extension shaft is hinged to the second end of the elongated handle by means of the second hinge. The second end of the extension shaft has an elongated handle grip perpendicular to and substantially centered about the extension shaft.

The distance between the second hinge and the driver defines a first moment arm. The extension shaft pivots about the second hinge through a arc less than 360 degrees. The distance between the driver and the first hinge defines a second moment arm. The elongated handle pivots about the first hinge from a position perpendicular to the driver, and parallel to the second moment arm, to a position parallel to the driver and perpendicular to the second moment arm.

The tool can be placed in a first position where the elongated handle is perpendicular to the driver or a second position where the elongated handle is pivoted about the first hinge in an amount defined by the requirements of the work space. In either position, the tool can be used to install or remove nuts by exerting the required force along the longitudinal axis of the extension shaft while grasping the extension shaft's T-gripped handle.

A second embodiment of the wrench is also disclosed wherein the hinge connection between the socket driver head and the elongated handle is replaced with a fixed connection. The tool includes a wrench handle fixed to a socket driver head at one end and a pivoting T-gripped extension shaft at the opposite end. This embodiment maintains the advantage of a T-gripped extension shaft in a fixed-head style wrench.

More specifically, in the second embodiment, the tool comprises an elongated handle with a first end and a second end. A longitudinal axis is defined along the elongated handle between the first end and second end. A tool engaging head including a driver is fixed to the first end where the driver has a single axis of rotation perpendicular to the longitudinal axis of the elongated handle.

The elongated handle further comprises a hinge at the second end. The hinge has a single axis of rotation that is parallel to the axis of the driver.

Additionally, an extension shaft with a first end and a second end is provided. The first end of the extension shaft is hinged to the second end of the elongated handle by means of the hinge. The second end of the extension shaft has an elongated handle grip perpendicular to and substantially centered about the extension shaft. The distance between the second hinge and the driver defines a moment arm. The extension shaft pivots about the second hinge through a arc less than 360 degrees.

With both embodiments, the inclusion of an extension shaft allows the user to reach a confined work space not readily accessible with a standard fixed handle ratchet wrench. In addition, because the T-gripped handle is perpendicular to the extension shaft, the user may exert considerable force on the elongated handle through the extension shaft while maintaining a comfortable grasping position with the hand and fingers substantially parallel to the forearm. Further, in the pivoting socket driver head embodiment, the ability of the elongated handle to pivot to a second position allows the tool to function in a work space where obstructions would limit the movement of the elongated handle if it remained in the first position.

In a preferred embodiment, the ratchet wrench tool has an extension shaft that is pivotally attached to one end of the elongated handle. The extension handle has a substantially U-shaped bend at the end opposite the pivot connection. The U-shaped bend of the extension handle includes a magnetic member for retrieving a metallic article or magnetic probe. The magnet member is generally recessed within a slot or depression of the U-shaped bend and enclosed within a resilient cover that is conventionally secured to the handle end. A locking hinge pin retains the end of the extension shaft within the clevis of the elongated handle. The handle end of the extension shaft is generally perpendicular to and centered upon the extension shaft.

Accordingly, it is a principal object of the invention to provide a ratchet-based driving tool with an extension shaft pivotally connected to the handle that allows the user to take advantage of the leverage created by the handle's moment arm when working in a confined space not easily accessible with a standard fixed handle wrench.

It is a further object of the invention to provide a ratchet-based driving tool with a T-gripped handle that permits the user to remotely manipulate the driver by grasping the handle with the hand and fingers substantially parallel to the forearm in order to exert force on the extension shaft in a comfortable manner.

It is a further object of the invention to provide a ratchet-based driving tool for working in confined spaces with a head socket driver pivotally attached to the wrench handle and driven by the back and forth motion of the wrench handle through the exertion of appropriately alternating forces on the pivoting T-gripped extension shaft.

It is a further object of the invention to provide a ratchet-based driving tool for working in confined spaces with a head socket driver pivotally attached to the wrench handle and driven by the back and forth motion of the wrench handle through the exertion of alternating forces on the pivoting extension shaft.

It is also a principal object of the invention to provide a ratchet-based driving tool with an extension shaft pivotally connected to the handle that allows the user to take advantage of the leverage created by the handle's moment arm when working in a space not easily accessible with a standard fixed handle wrench.

It is a further object of the invention to provide a ratchet-based driving tool with a U-shaped handle bend that permits the user to remotely manipulate the driver by grasping the handle with the hand and fingers substantially parallel to the forearm in order to exert force on the extension shaft in a comfortable manner.

It is yet a further object of the invention to provide a ratchet-based driving tool with a magnetic U-shaped handle bend that permits the user to retrieve magnetic-attracting articles that are out of arms reach by reversing and extending the extension shaft in a manner that permits the user to maintain a comfortable working position.

It is another object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
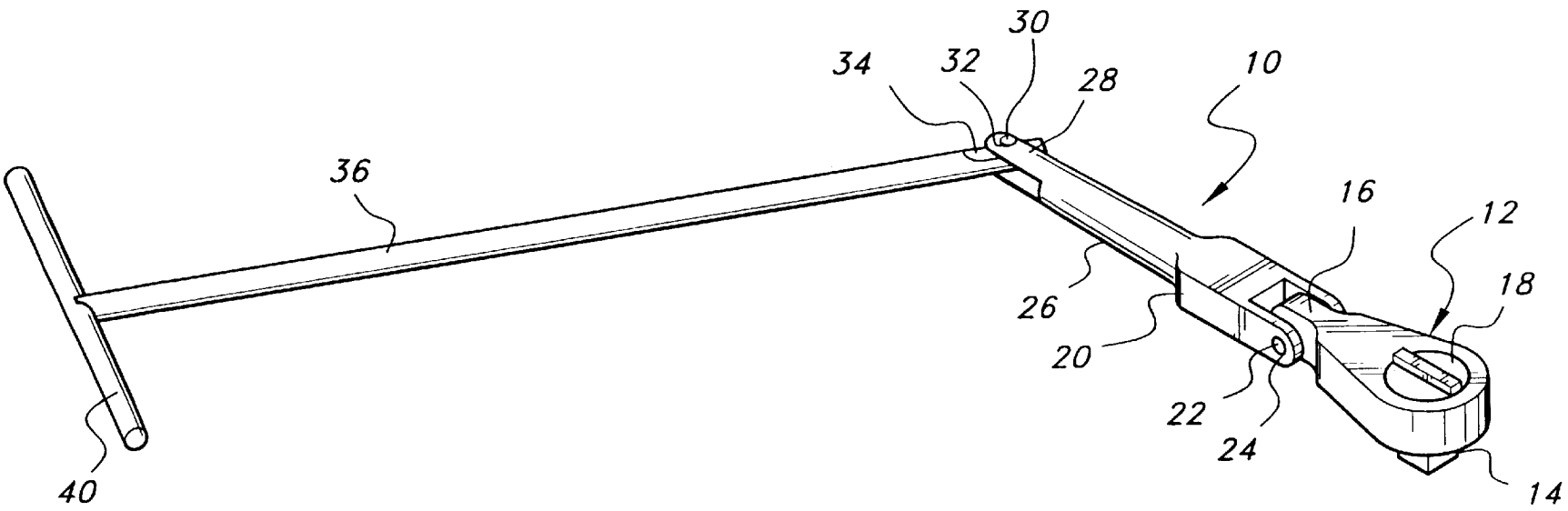
FIG. 1 is a perspective view of a first embodiment of an adjustable head ratchet wrench made according to the present invention with an extension shaft shown in a pivoting relationship with an elongated handle.
Figure 2:
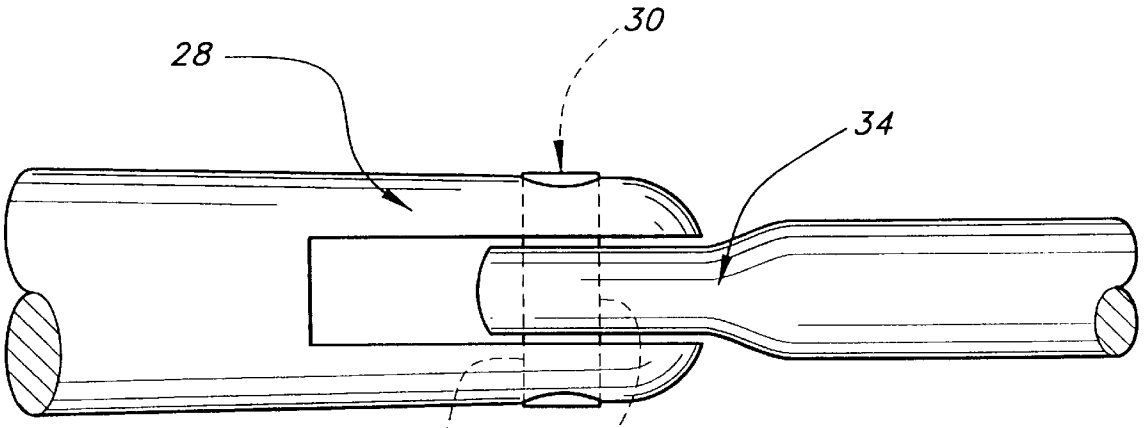
FIG. 2 is a fragmentary elevational view of the wrench of FIG. 1 showing the extension shaft in alignment with the elongated handle.
Figure 3:
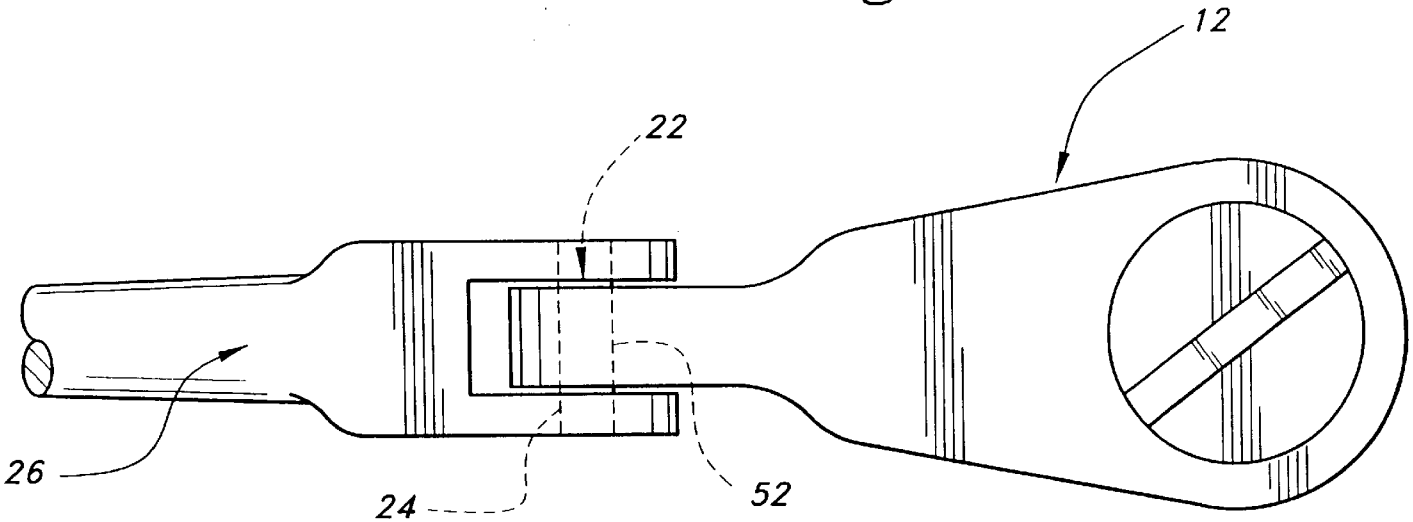
FIG. 3 is a fragmentary top plan view of the wrench of FIG. 1 showing the elongated handle in alignment with the wrench head.

With reference first to FIG. 1, the wrench of the subject invention is shown generally at 10 and comprises a socket driver head 12, an elongated handle 26, and an extension shaft 36. With reference now to FIGS. 1–3, the individual items will be described in greater detail.

The socket driver head is shown generally at 12 and houses a square driver 14 extending perpendicularly to a length of the socket driver head, and a first shank 16 having a cylindrical opening 52 therethrough. The socket driver head 12 is preferably of the ratchet type with a ratchet direction selector 18, where torque can be applied to the square driver in one sense, and then the head can be rotated freely back to the original position, leaving the square driver unaffected.

The elongated handle 26 has at one end a first clevis 20 having a cylindrical opening 24 therethrough which also defines an axis of rotation, where cylindrical openings 24 and 52 are cooperatively profiled to receive a hinge pin 22 therethrough. The elongated handle further comprises a second clevis 28 having a cylindrical opening 32 therethrough which also defines an axis of rotation, wherein the axis of rotation of the second clevis is perpendicular to the axis of rotation of the first clevis.

The extension shaft 36 includes a second shank 34 having a cylindrical opening 50 therethrough, where cylindrical openings 50 and 32 are cooperatively profiled to receive a hinge pin 30 therethrough. The extension shaft 36 further comprises an extended handle grip 40 perpendicular to and substantially centered about the extension shaft.

Figure 4:
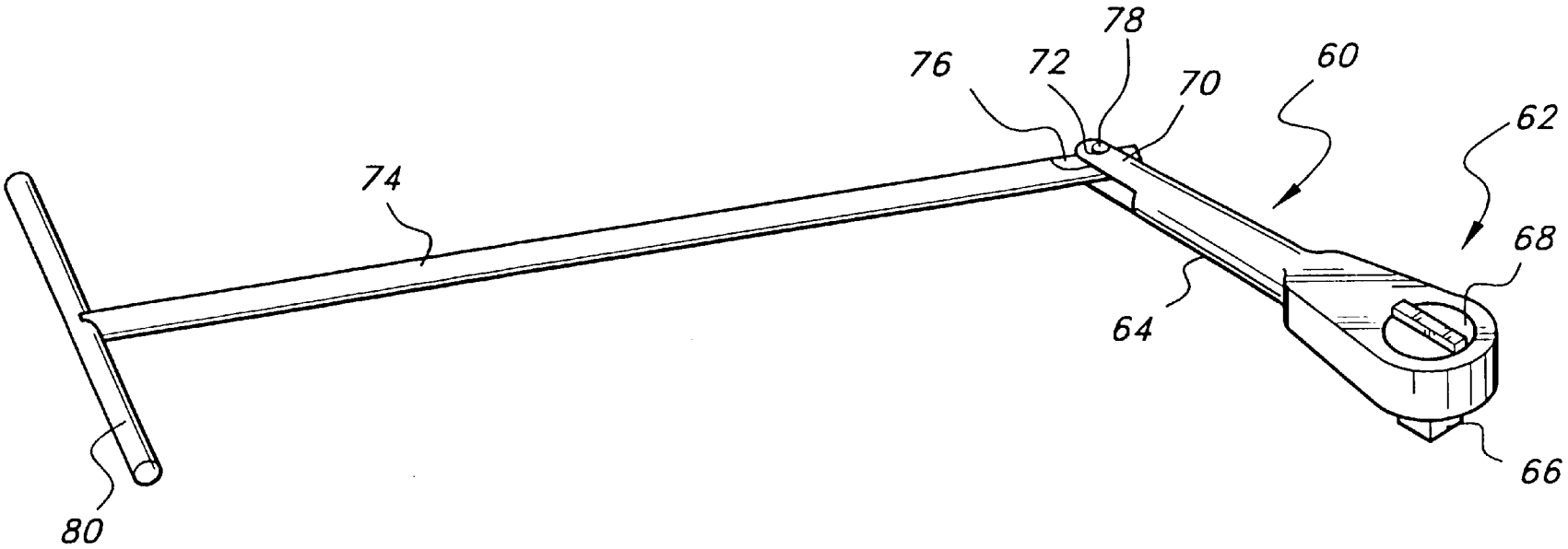
FIG. 4 is a perspective view of a second embodiment of a ratchet wrench made according to the present invention with an extension shaft shown in a pivoting relationship with an elongated handle.
Figure 5:
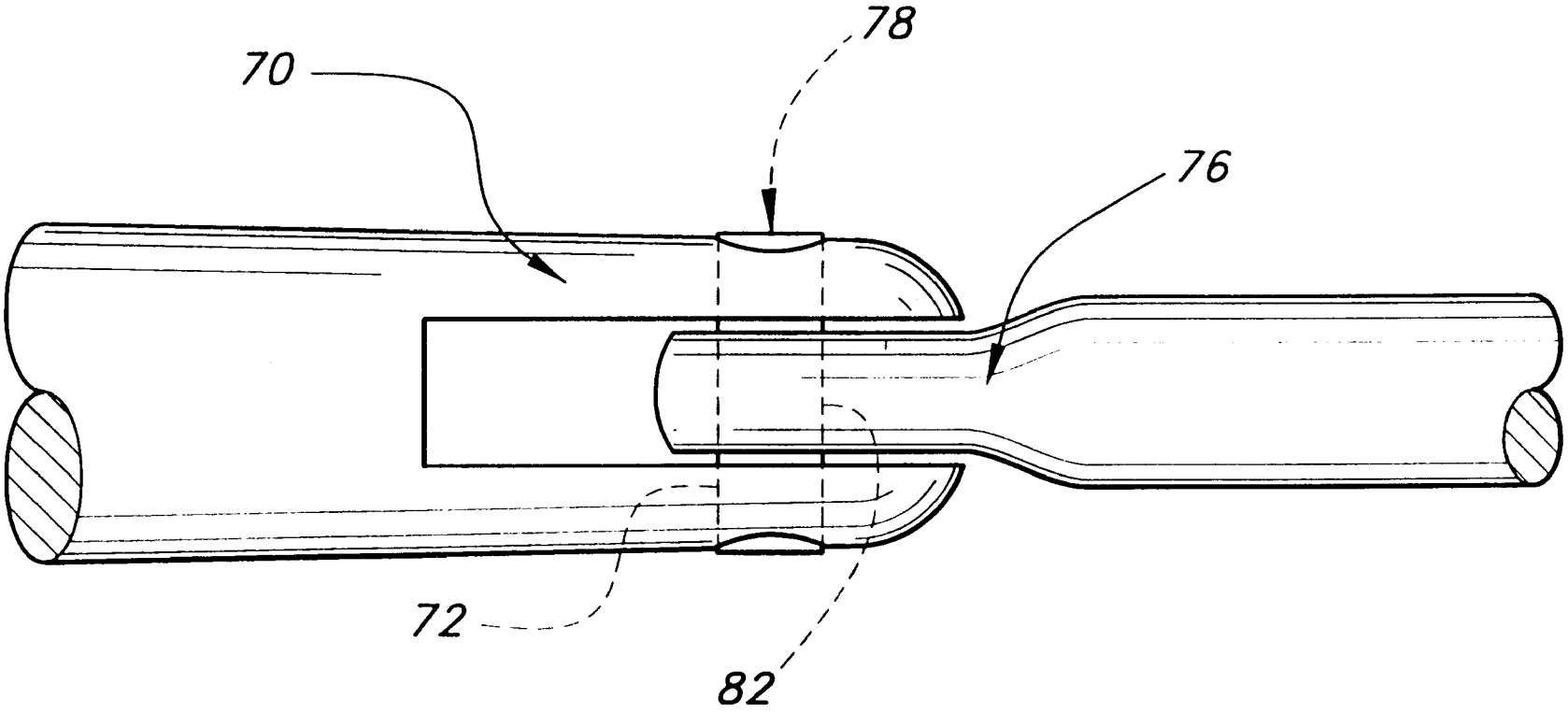
FIG. 5 is a fragmentary elevational view of the wrench of FIG. 4 showing the extension shaft integral to the head in alignment with the elongated handle.
Figure 6:
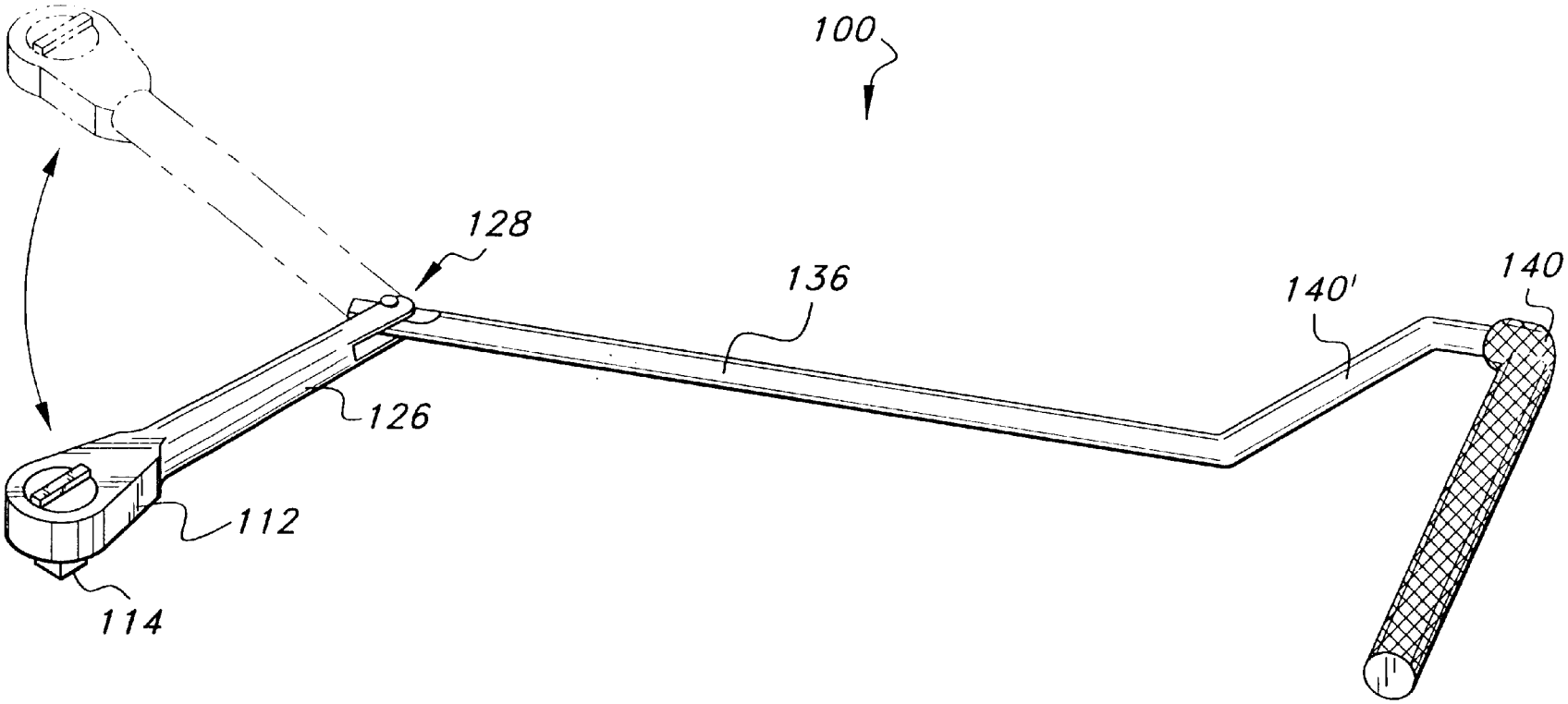
FIG. 6 is a perspective view of the preferred embodiment according to the present invention.

Referring now to FIGS. 4 and 5, a second embodiment of the wrench is disclosed wherein the hinge connection between the socket driver head and the wrench handle is replaced with a fixed connection. As in the first embodiment of the wrench, the wrench of the subject invention, shown generally at 60, comprises a socket driver head 62, an elongated handle 64, and an extension shaft 74.

The socket driver head is shown generally at 62 and houses a square driver 66 extending perpendicularly to a length of the socket driver head. The socket driver head 62 is preferably of the ratchet type with a ratchet direction selector 68, where torque can be applied to the square driver in one sense, and then the head can be rotated freely back to the original position, leaving the square driver unaffected.

The elongated handle 64 has a first end and a second end. The first end is rigidly connected to the socket driver head 62. The elongated handle further comprises at the second end a clevis 70 having a cylindrical opening 72 therethrough which also defines an axis of rotation, wherein the axis of rotation of the clevis is parallel to the axis of rotation of the square driver 66.

The extension shaft 74 includes a shank 76 having a cylindrical opening 82 therethrough, where cylindrical openings 82 and 72 are cooperatively profiled to receive a hinge pin 78 therethrough. The extension shaft 74 further comprises an extended handle grip 80 perpendicular to and substantially centered about the extension shaft.

Referring now to FIGS. 6–8, and 10, a preferred embodiment is shown. The wrench of the preferred embodiment is shown generally at 100 and has a socket driver head 112, an elongated handle 126, and an extension shaft 136. The elongated handle has a first end and a second end. The first end and the second end defining a predetermined length therebetween. The elongated handle has a longitudinal axis extending the length thereof.

The first end of the elongated handle has the socket driver head 112 fixedly attached thereto. The socket driver head 112 houses a square driver 114 extending perpendicularly to the predetermined length and longitudinal axis of the elongated handle 126. The socket driver head 112 is preferably of the ratchet type, as set forth in FIG. 1 above, for turning workpieces 204 (see FIG. 9).

The second end of the elongated handle 126 has a clevis 128, which hingedly cooperates with the extension shaft 136 at one end thereof. The extension shaft 136 has a generally U-shaped bend 140' forming a handle grip 140 at the other end thereof. The generally U-shaped handle grip generally resembles a cane-type handle end.

Figure 7:
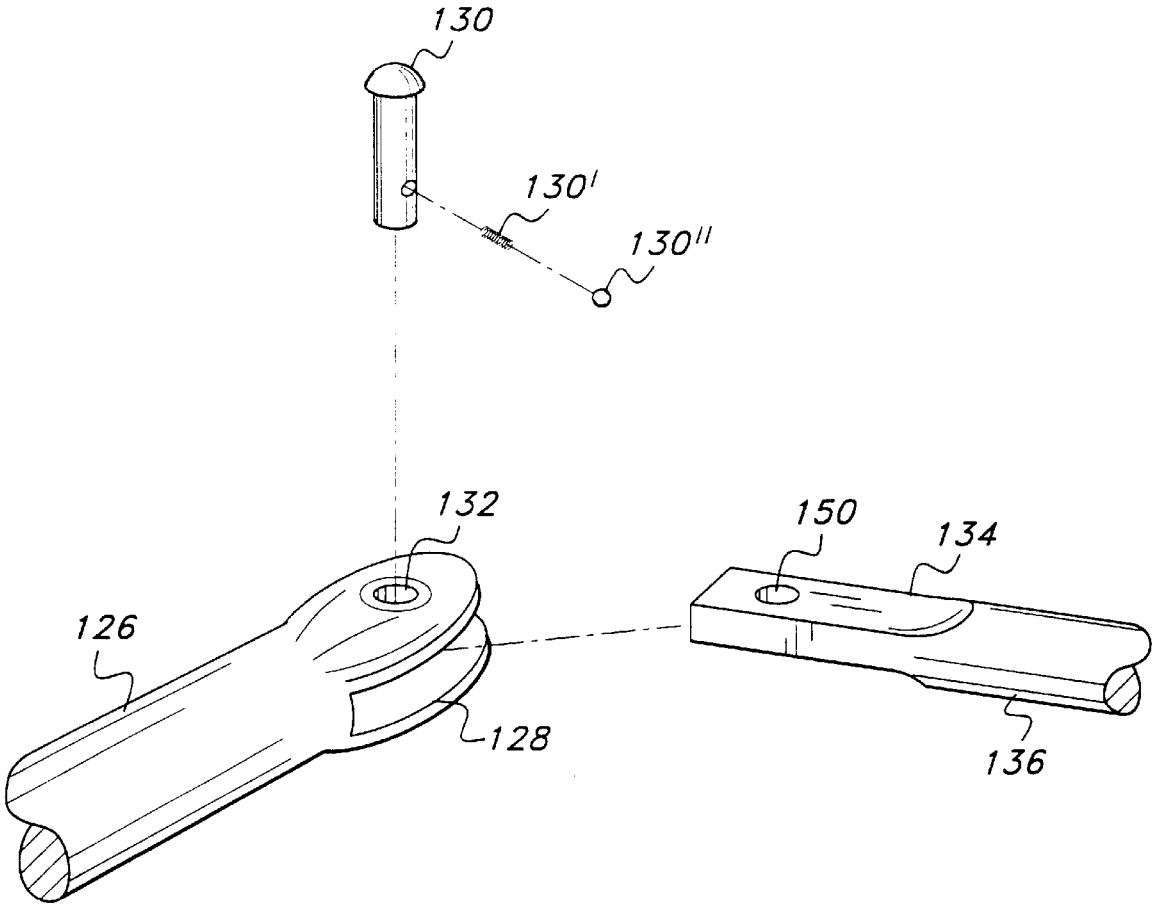
FIG. 7 is an exploded perspective view of the pivoting hinge of the preferred embodiment of FIG. 6 according to the present invention.

As seen in FIG. 7, the extension shaft 136 includes a shank 134 having an aperture 150 therethrough. The clevis 128 of the elongated handle has a pair of apertures 132 juxtaposed and configured to align with the aperture 150 of the extension shaft 136. A locking hinge pin 130 penetrates and secures the shank 134 of the extension within the clevis 128 of the elongated handle 126. Locking hinge pin 130 includes a biassing spring member 130' and a movable tumbler 130". The movable tumbler 130" is generally represented as a ball bearing, but a cylindrical element, or the like, would also be suitable. In addition, the locking hinge pin 130 may include an end flange and a C- or E-clip for securing the pin in the apertures. Once assembled, the clevis 128, the shank 134 and the pin 130 cooperatively form a hinge, allowing relative rotation between the elongated handle and the extension shaft through an arc of less than 360°.

Figure 8:
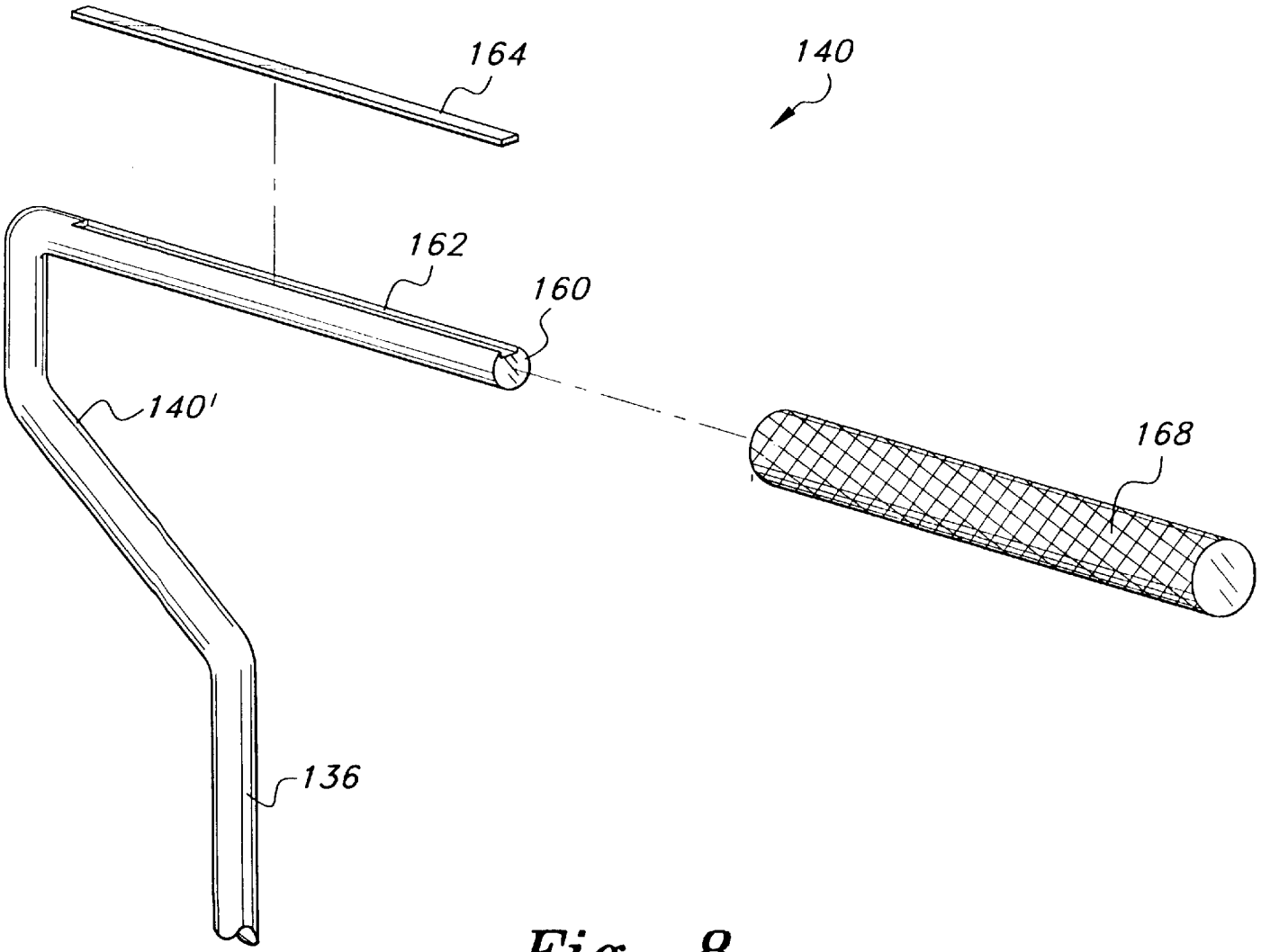
FIG. 8 is an exploded perspective view of the U-shaped handle of the preferred embodiment of FIG. 6 according to the present invention.
Figure 10:
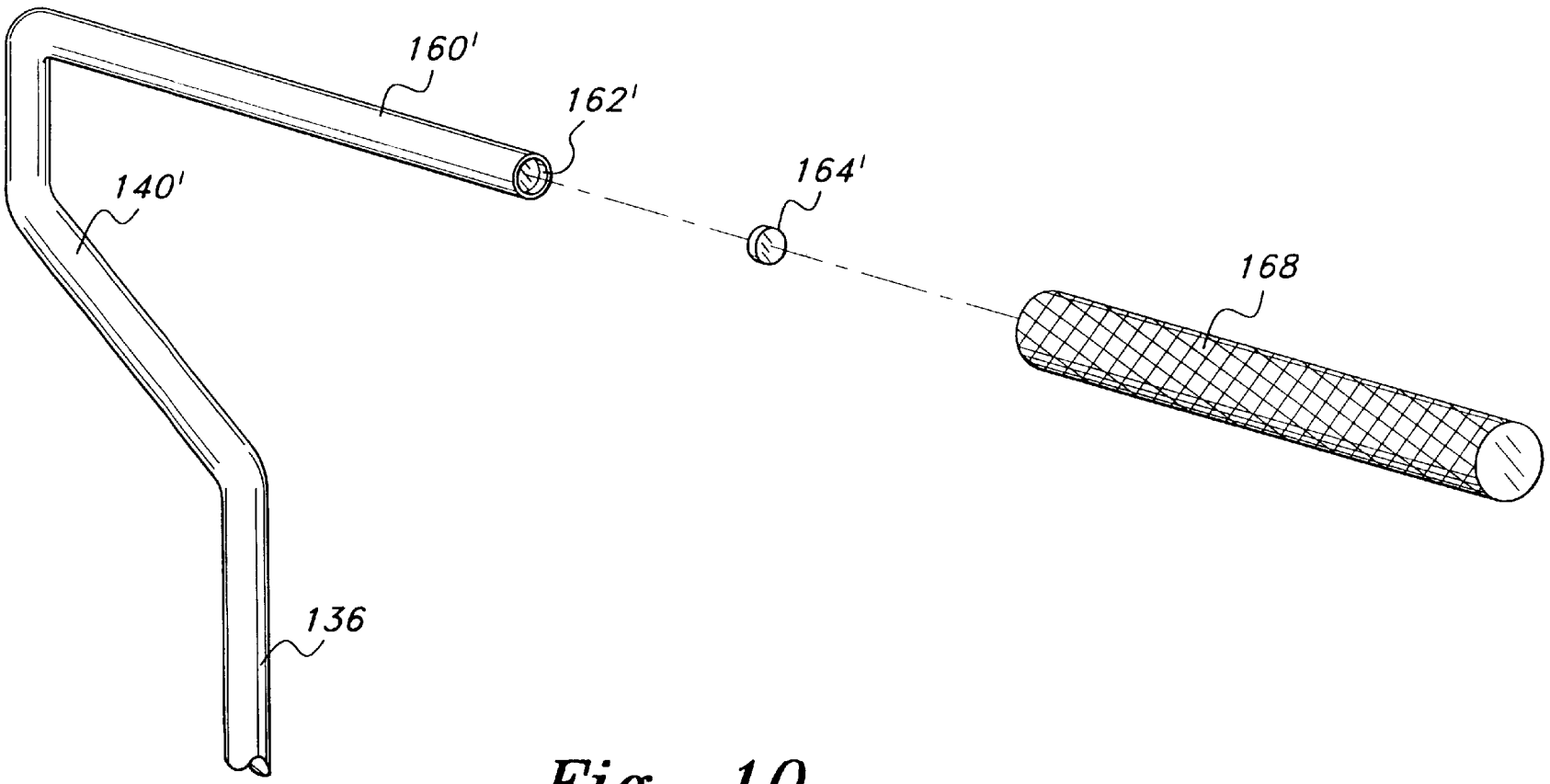
FIG. 10 is an alternative exploded perspective view of the U-shaped handle of the preferred embodiment of FIG. 6 according to the present invention.

Referring specifically to FIGS. 8 and 10, the U-shaped handle grip of extension shaft 136 is shown having alternative arrangements. In FIG. 8, the handle grip 140 includes a linear section 160 having a longitudinal slot 162, and a permanent bar type magnet 164 that is received in the longitudinal slot 162. A resilient cover 168 envelopes the linear section 160 of the handle grip 140, the magnet 164 up to and/or including a portion of the U-shaped bend 140'. The linear section 160 of U-shaped bend 140' is perpendicular to and substantially centered about the extension shaft 136. Like FIG. 8, FIG. 10 shows the linear section 160' of the handle grip 140 with a recess or tip end depression 162'. A disk type magnet 164' is received in the recess or tip end depression 162', and likewise is completely enveloped by the resilient cover 168. The resilient cover 168 is of any conventional material that may be securely attached to the linear section 160,160' by any conventional means. Materials such as rubber, foam rubber, etc., that provide a comfortable, graspable handle would be suitable for resilient cover 168.

Figure 9:
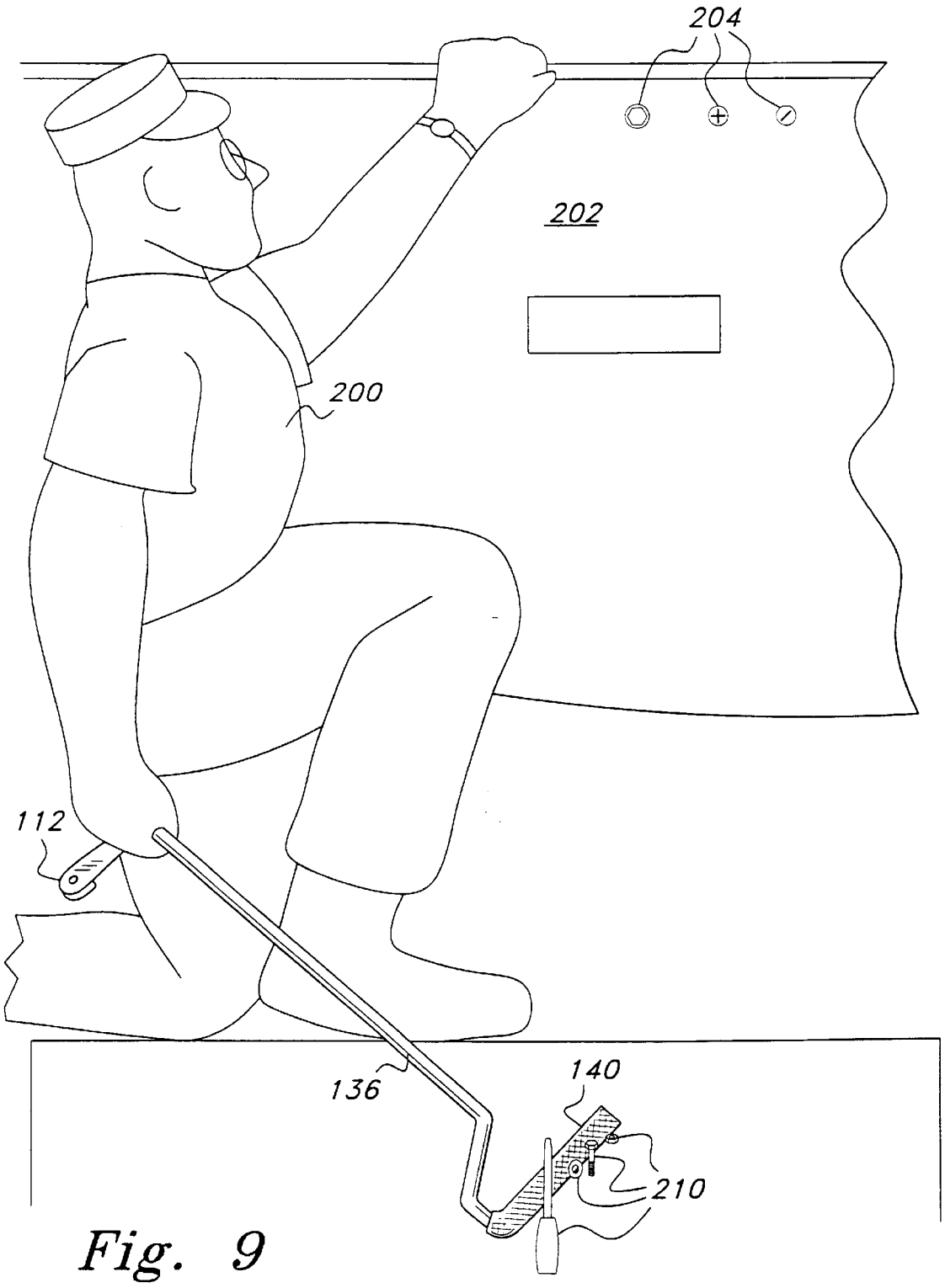
FIG. 9 is a environmental view of a person using the preferred embodiment of FIG. 6 according to the present invention.

In operation, the ratchet wrench 112 and extension shaft 136 provide extreme leverage in the "so-called hard to reach" environments, as discussed with respect to FIGS. 1–5 above. The wrench, via the moment arm defined by the predetermined length of the elongated handle 126, when combined with the extension shaft 136, allows the user 200 greater torque without increased physical exertion. The user 200 of wrench 100 is positioned so as to provide greater leverage and reduced body fatigue. In the preferred embodiment, as seen in FIG. 9, the user 200 is able to retrieve tools or workpieces 210 that are beyond his reach. This is accomplished by the magnet 164,164' in the handle grip 140. The ability to retrieve article 210 is important when the user 200 is working in confined or elevated environments. The user 200 is able to continuously work with very little interruption upon inadvertently dropping a workpiece. The purpose of having the magnet 164,164' in the handle grip 140 of the extension shaft 136 is so that the magnetic effects do not interfere with the work unit. For example, if the magnet 164,164' was in the driver head 112, then the user 200 would constantly be freeing the tool 100 from the work unit. By having the magnet 164,164'0 in the handle grip 140, it is out of the way when not needed. When needed, the user 200 simply reverse the extension shaft 136, holding the extension shaft 136 at the shank 134 and using the handle grip 140 as a magnet probe or retriever.

It is to be understood that the present invention is not limited to the embodiments described above, but encompasses any and all embodiments within the scope of the following claims.

I claim:

1. A ratchet wrench tool comprising:

an elongated handle of predetermined length having a first end, a second end and a longitudinal axis defined therebetween;

a tool engaging head disposed at said first end of said elongated handle, said tool engaging head including a ratcheting driver extending from said tool engaging head in a direction perpendicular to the longitudinal axis of said elongated handle, said ratcheting driver having a single axis of rotation;

a hinge disposed at said second end of said elongated handle, said hinge having a single axis of rotation parallel with said axis of rotation of said ratcheting driver, said axis of rotation of said hinge being perpendicular to said longitudinal axis of said elongated handle; and an extension shaft with a first end and a second end, said first end of said extension shaft being coupled to said hinge at said second end of said elongated handle, and said second end of said extension shaft having a handle grip perpendicular to and substantially centered about said extension shaft;

said handle grip including a longitudinal slot having a bar magnet disposed therein and a resilient cover enveloping said bar magnet and said handle grip.

2. The rachet wrench tool according to claim 1, said predetermined length being between said hinge and said ratcheting driver and defining a moment arm, and said extension shaft being rotatable about said hinge through an arc of less than 360 degrees.

3. The rachet wrench tool according to claim 1, wherein said handle grip is fixedly coupled to said extension shaft by a generally U-shaped bend.

4. A A ratchet wrench tool comprising:

an elongated handle of predetermined length having a first end, a second end and a longitudinal axis defined therebetween;

a ratcheting driver head disposed at said first end of said elongated handle and extending from said elongated handle in a direction perpendicular to the longitudinal axis of said elongated handle, said ratcheting driver head having a single axis of rotation;

a clevis disposed at said second end of said elongated handle, said clevis having a pair of juxtaposed apertures;

an extension shaft having a first end and a second end, said first end of said extension shaft including a shank, said shank having an aperture therein, said shank being disposed within said clevis, whereby said pair of juxtaposed apertures of said clevis and said aperture of said shank being aligned;

pin means for pivotally coupling said shank within said clevis by penetrating each of said apertures, said pin means having resilient locking means for securing said pin means in said apertures;

whereby said pin means defines a single axis of rotation parallel with said axis of rotation of said ratcheting driver head and said single axis of rotation being perpendicular to said longitudinal axis of said elongated handle;

said second end of said extension including a rigid generally U-shaped joint and a handle grip, said U-shaped joint fixedly disposing said handle grip perpendicular to and substantially centered about said extension shaft;

said handle grip including magnet means for attracting metallic tool pieces and a resilient cover means fixedly enveloping said magnet means and said handle grip, whereby said resilient cover means provides a comfortable and secure grip for grasping said handle grip.

5. The rachet wrench tool according to claim 4, wherein said handle grip includes a linear section having a longitudinal slot, wherein said magnet means is a bar magnet disposed in said longitudinal slot.

6. The rachet wrench tool according to claim 4, said handle grip including a tip end depression, wherein said magnet means is a disk magnet disposed in said tip end depression.

* * * * *